United States Patent [19]

Yamamoto et al.

[11] 3,970,384

[45] July 20, 1976

[54] SAFETY DEVICE FOR PHOTOCOPYING MACHINE

[75] Inventors: Eisuke Yamamoto, Tokyo; Susumu Sugiura; Osamu Sawamura, both of Yamato, all of Japan

[73] Assignee: Canon Kabushiki Kaisha, Tokyo, Japan

[22] Filed: Dec. 2, 1974

[21] Appl. No.: 528,788

Related U.S. Application Data

[63] Continuation of Ser. No. 325,339, Jan. 22, 1973, abandoned.

[30] Foreign Application Priority Data

Jan. 25, 1972 Japan ..... 47-9339

[52] U.S. Cl. ..... 355/14; 271/259

[51] Int. Cl.[2] ..... G03G 15/00

[58] Field of Search ..... 355/3 R, 14; 271/57; 340/259

[56] References Cited

UNITED STATES PATENTS

| | | | |
|---|---|---|---|
| 3,512,885 | 5/1970 | Osborne et al. | 355/14 |
| 3,586,450 | 6/1971 | Hosey et al. | 355/14 X |
| 3,674,363 | 7/1972 | Baller et al. | 355/14 |
| 3,693,969 | 9/1972 | Sakamaki et al. | 355/14 |
| 3,734,604 | 5/1973 | Szostak et al. | 271/57 |
| 3,737,159 | 6/1973 | Washio et al. | 271/57 |

*Primary Examiner*—L. T. Hix
*Assistant Examiner*—Richard M. Sheer
*Attorney, Agent, or Firm*—Fitzpatrick, Cella, Harper & Scinto

[57] ABSTRACT

The exhaust of stocked copying paper and the failure in feeding copying paper are detected so that means for driving a feeding system may be immediately stopped, and no failure in feeding copying paper is detected and failure in discharging copying paper is detected so that every operation in the photocopying machine may be stopped and also the power supply to the photocopying machine may be interrupted. The highly efficient and safeguarded operation of the photocopying machine may be ensured.

1 Claim, 7 Drawing Figures

SAFETY DEVICE FOR PHOTOCOPYING MACHINE

This is a continuation of application Ser. No. 325,339, filed Jan. 22, 1973, now abandoned.

BACKGROUND OF THE INVENTION

1. Field of the Invention

The present invention relates to a safety device for a photocopying machine especially of the type having a thermal fixing means.

2. Description of the Prior Art

The conventional copying or photocopying machines are generally provided with a safety device of the type in which an expectant time when a copy is to be discharged out of the photocopying machine is measured from the time when the actuation of a copying paper feeding system is started so that when the copy is not discharged out of the photocopying machine even after the expectant time, the alarming signal indicating the possibility of jamming of copying paper in the fixing station is generated so as to stop the operation of the photocopying machine. The safety device of the type described also interrupts the operation of the photocopying machine at the time when the stocked copying paper is exhausted or run out when the timing of feed of copying paper is delayed or when the failure in feeding copying paper occurs due to the slippage of copying paper over feed rollers. Every time when the operation of the photocopying machine is stopped, the heaters in the fixing station are de-energized so that the photocopying operation cannot be resumed immediately after the cause for failure has been checked and removed by an operator because the fixing station is cooled to a temperature below the operating temperature. It generally takes a long time before the temperature in the fixing station rises to the operating temperature.

Furthermore there is a danger for an unskilled operator to restart the photocopying machine without removing the real cause for jamming so that jamming occurs again immediately, thus leading to the serious damages to the photocopying machine.

An object of the present invention is therefore to provide an improved safety device for a photocopying machine which functions depending upon the causes for failures in feeding and discharging photocopying paper so that the safeguarded and efficient operation of the photocopying machine may be ensured.

SUMMARY OF THE INVENTION

Briefly stated, according to the present invention the safety device is provided with three independent timing means which are operated in synchronism with the operation of a driving system for a copying paper feed system. The first timing means is used for detecting the condition of feed of copying paper; the second timing means is used for detecting the time delay in transportation of copying paper through the various processing stations in the photocopying machine; and the third timing means is used for detecting whether or not the copy is correctly discharged out of the photocopying machine. According to the present invention, means for detecting the failure in feeding copying paper is provided whose input comprises at least one switching means which is disposed in the passage extending from a copying paper storage to a fixing station and are actuable by copying paper being transported. Means for detecting the failure in feeding copying paper is actuated in synchronism with said first timing means. Means for detecting the failure in copy discharge is actuated in synchronism with said second and third timing means. Furthermore, means is provided which may stop means for driving the copying paper feed system in response to the output signal from means for detecting the exhaust of stocked copying paper and/or signal from means for detecting the failure in feeding copying paper. The present invention further provides emergency means for stopping the operation of the photocopying machine in response to the signal from means for detecting the failure in copy discharge which is actuated in synchronism with the second and third timing means when the correct feed of copying paper has been confirmed by said feed-failure detecting means. Preferably mechanical lock means which is actuated in response to the actuation of said emergency means is provided for mechanically locking the operation of the photocopying machine until the cause for failure in feed and/or discharge of copying papers is removed.

The above and other objects, features and advantages of the present invention will become more apparent from the following description of one preferred embodiment thereof taken in conjunction with the accompanying drawing.

Figure 1:
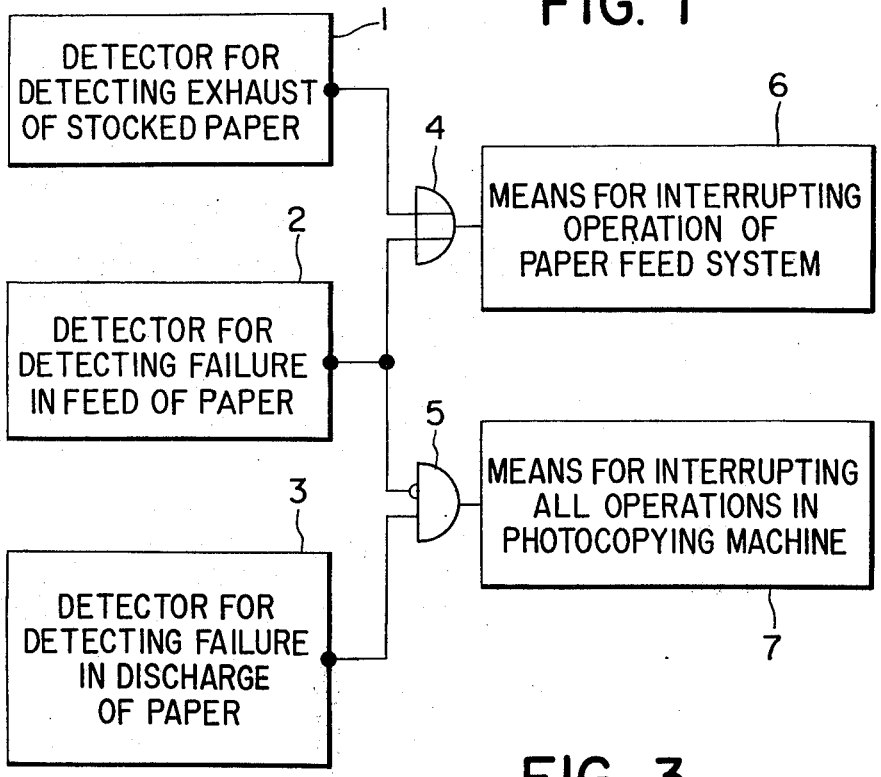
FIG. 1 is a block diagram for explanation of operation of a safety device in accordance with the present invention.

DESCRIPTION OF THE PREFERRED EMBODIMENT:

The Principle, FIG. 1

First referring to FIG. 1, the underlying principle of the present invention will be described. Means 6 for stopping or interrupting the operation of the paper feed system is actuated in response to the signal applied through an OR gate 4 from either of a detector 1 for detecting the exhaust of stocked paper or detector 2 for detecting the failure in paper feed. Means 7 for stopping or interrupting the whole operation of the copying machine is actuated in response to the signal applied through an inhibit gate 5 which outputs the signal in response to the absence of output signal from the paper-feed-failure detector 2 and the presence of output signal from detector 3 for detecting the failure in discharge of copied paper.

Figure 2:
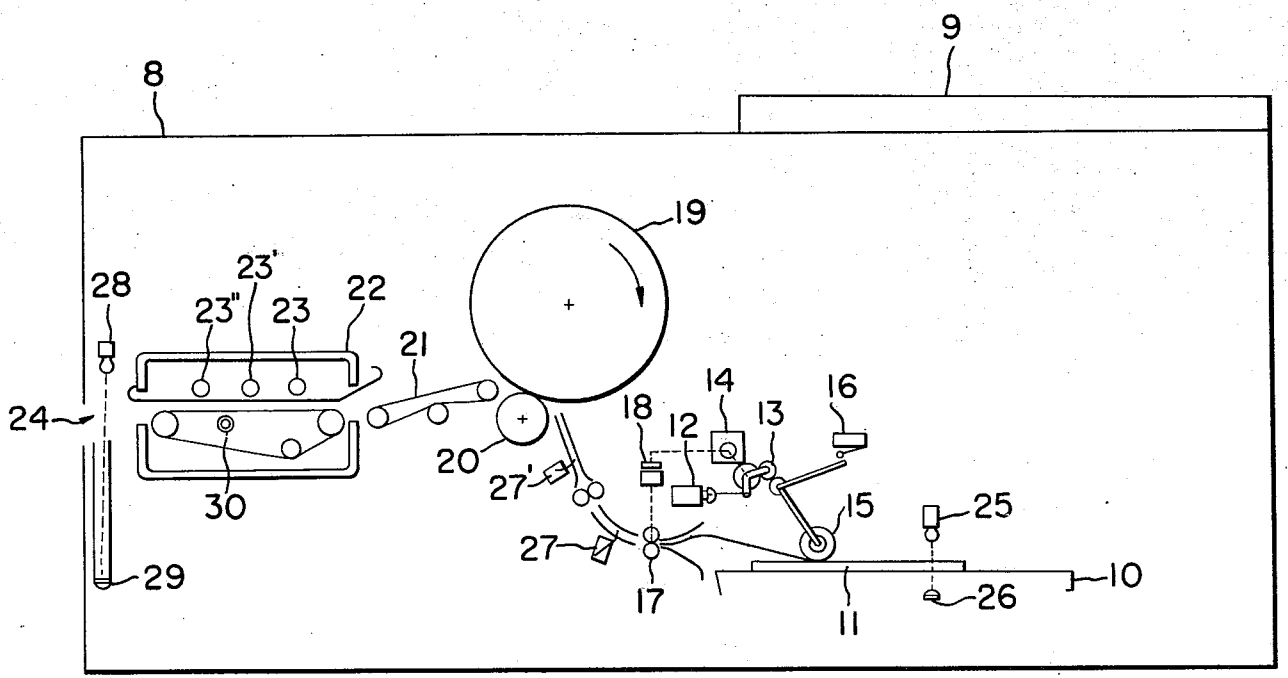
FIG. 2 is a schematic side view of a copying paper feed system.

Copying Paper Feed System, FIG. 2

The copying machine to which is applied the present invention is of the type in which an original holder 9 reciprocates for exposure on the top of a copying machine casing 8 as shown in FIG. 2. In the copying paper feed system shown in FIG. 2 a solenoid 12 is first energized so that the rotation of a main motor 14 is transmitted through a linkage 13 to a paper pick-up roller 15 in order to feed copying paper 11 stacked upon a copying paper holder 10. When the pick-up roller 15 is not actuated, that is when it is not in the lowered position a microswitch 16 is turned on. Copying paper 10 picked up by the pick-up roller 15 is directed toward a pair of feed rollers 17 which are rotated by the main motor 14 when a clutch 18 is engaged, and is transported toward a photosensitive drum 19. Then a visible toner image upon the photosensitive drum is transferred onto copying paper 11 by means of an image-transfer roller 20. Thereafter the copying paper 11 is transported by a conveyor belt 21 into an image fixing station 22 where the transferred toner image is fixed to the copying paper 11 by heating means 23. The copy thus obtained is discharged through a discharge outlet 24.

In the copying paper holder 10 are disposed light emissive means or lamp 25 and light responsive mean, for example, a photoelectric cell 26 for detecting the exhaust of the copying paper stocked on the paper holder 10. In the passage of copying paper are disposed microswitches 27 for detecting the failure in feeding copying paper, and between the outlet of the fixing station 22 and the discharge outlet 24 are disposed light emissive means or lamp 28 and light responsive means, for example, a photoelectric cell 29 for detecting the failure in discharge of copying paper. The signals from these detectors are applied to the safety device in order to ensure the normal transportation of the copying paper through the copying machine.

Figure 3:
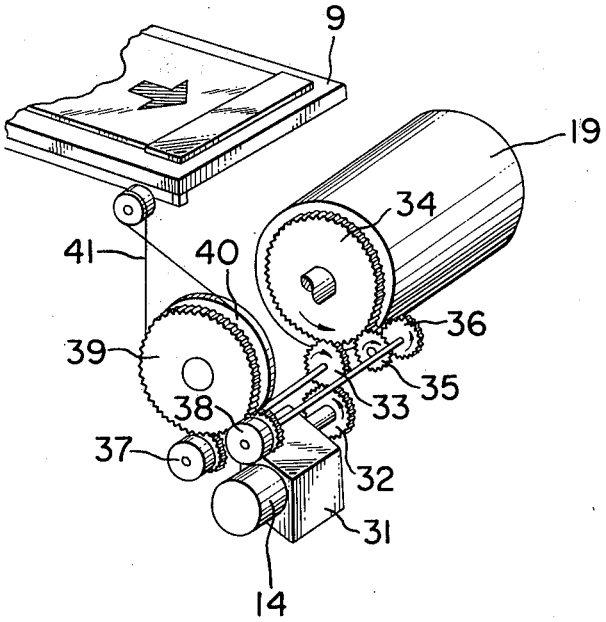
FIG. 3 is a perspective view of a driving system.

Driving System, FIG. 3

Since the copying paper feed system described above with reference to FIG. 2 is actuated in synchronism with the driving system for the copying machine, the latter will be described briefly with reference to FIG. 3. The rotation of the main motor 14 is transmitted to a gear 36 through a reduction gear box 31 and gears 32 and 33. The rotations of the gears 33 and 36 which are opposite in direction are transmitted through clutch gears 37 and 38 to a cam gear 39 so as to rotate the latter in the normal or reversed direction. Therefore the original holder 9 is reciprocated through a pulley 40 and a pulley belt or wire 41, the pulley 40 being made integral with the cam gear 39. That is, when the clutch 37 is engaged the pulley 40 is rotated in the normal direction so that the original holder 9 is advanced, but when the clutch 38 is engaged the pulley 40 is reversed in rotation so that the original holder 9 is retracted. A group of cams (not shown) disposed for engagement with the cam gear 39 actuate synchronizing switches 42–47 (See FIG. 4*a*).

Figure 4A:
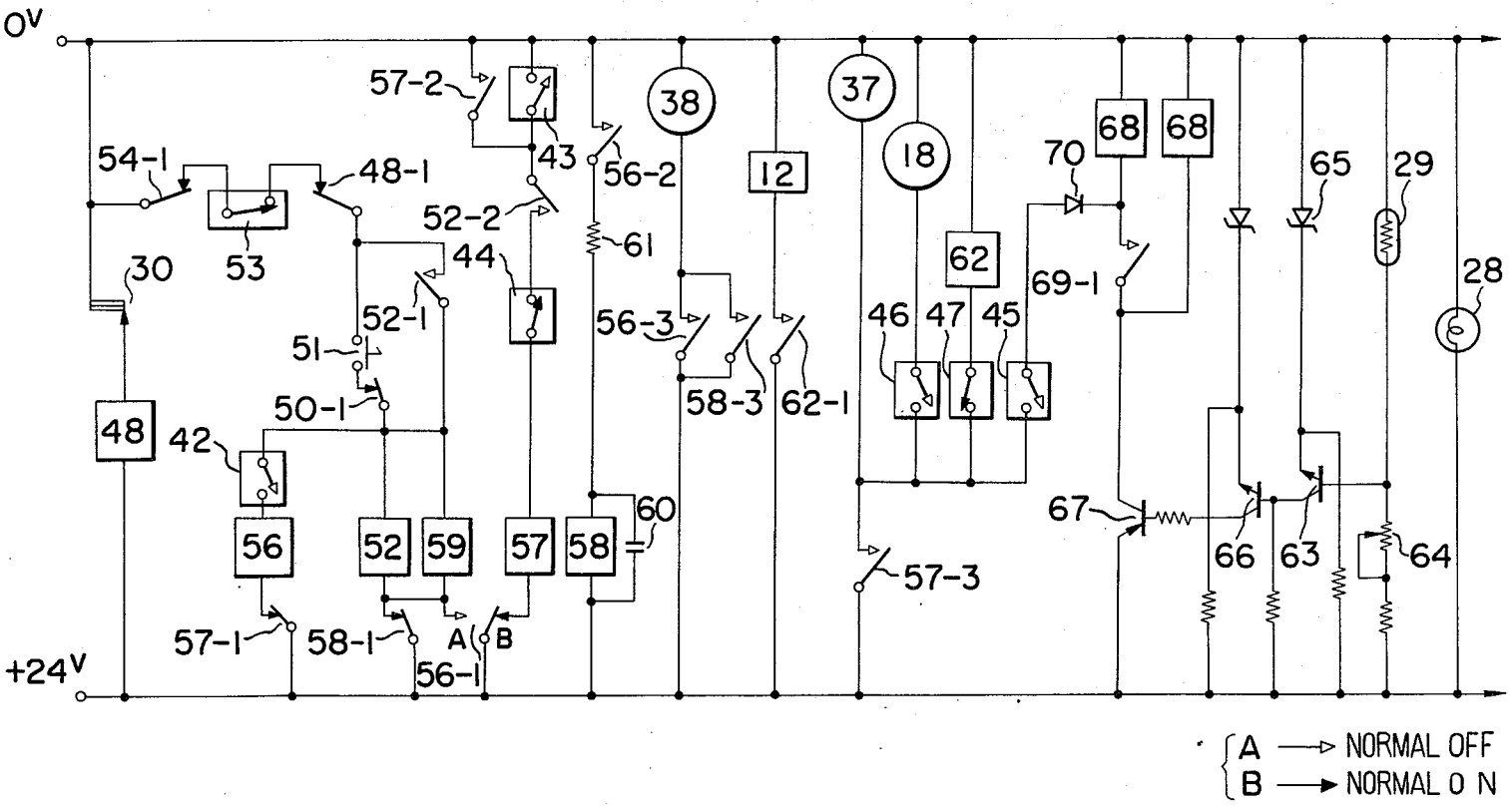
FIGS. 4*a*, 4*b*, and 4*c* are diagrams of an electric circuit of the safety device.
Figure 4B:
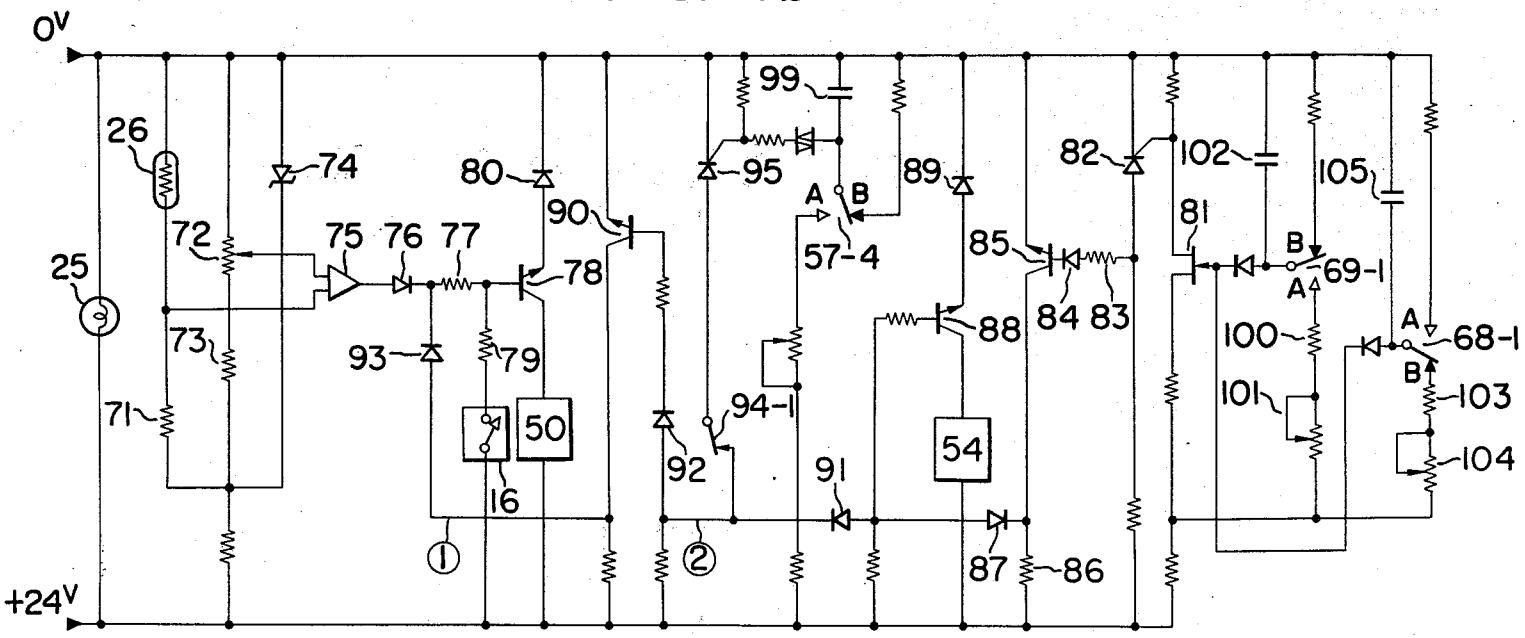
Figure 4C:
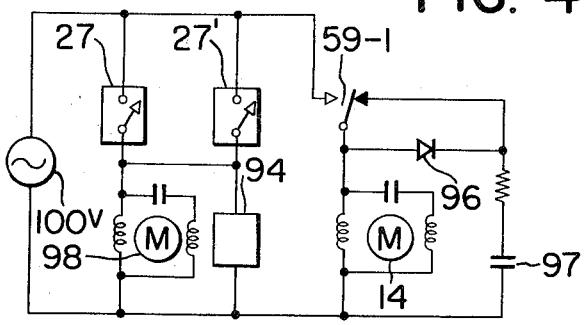

Safety Device, FIGS. 4*a*, 4*b* and 4*c*

Next the safety device in accordance with the present invention will be described in detail with reference to FIGS. 4*a*, 4*b* and 4*c*. A relay 48 whose one end is connected to a DC power source is grounded through a thermostat 30. A copy switch 51 which is connected in series to a contact 50-1 associated with a relay 50 for stopping the copying paper feed system, is connected in parallel with a self-holding contact 52-1 associated with a relay 52. The relay 52-1 is grounded through a contact 48-1 associated with a relay 48, a microswitch 53, and a contact 54-1 associated with an emergency relay 54 for stopping the whole operation of the copying machine. One common end of the parallel circuit of the copy switch 51 is connected to the DC power source through the microswitch 42, a relay 56 and a contact 57-1 associated with a relay 57. The contact 52-1 is connected to the DC power source through a contact 58-1 of a relay 58 which in turn is connected in series to a parallel circuit consisting of the relays 52 and 59. A transfer contact 56-1 associated with a relay 56 is connected in parallel with the contact 58-1.

Other contact B of the contact 56-1 is grounded through a series circuit consisting of a relay 57, the microswitch 44, and a contact 52-2 associated with a relay 52 and a parallel circuit consisting of the microswitch 43 and a contact 57-2 of a relay 57. (In this specification the normally-open contacts are indicated by adding A whereas the normally-closed contacts are indicated by adding B).

One terminal of a relay 58 which is connected in parallel with a time delay capacitor 60 is connected to the DC power source while the other terminal is grounded through a resistor 61 and a contact 56-2 associated with the relay 56. The clutch 38 for reversing the original holder 9 is connected to the DC power source through a parallel circuit comprising a contact 56-3 associated with the relay 56 and a contact 58-3 associated with a relay 58. One terminal of the solenoid 12 is grounded whereas the other terminal is connected through a contact 62-1 associated with a relay 62 to the DC power source. The photoelectric cell 29 for intercepting the light from the light emissive means 28 disposed at the paper discharge outlet 24 is interconnected between the ground and the base of a transistor 63. A suitable bias voltage is applied to the base of the transistor 63 through a variable resistor 64, and the emitter of the transistor 63 is grounded through a Zener diode 65. The collector of the transistor 63 is connected to the base of a transistor 66 whose collector is connected to the base of a transistor 67. The emitter and collector of the transistor 67 are connected to the DC power source and grounded through a relay 68, respectively. The collector of the transistor 67 is also grounded through a contact 69-2 and its relay 69.

The junction between the relay 69 and its contact 69-1 and the junction between the clutch 37 and the contact 57-3 of the relay 57 are connected with each other through a diode 70 and the microswitch 45. A series circuit consisting of the electromagnetic clutch 18 for transmitting the power to the feed rollers and the microswitch 46 as well as a series circuit consisting of the microswitch 47 and the relay 62 are connected in parallel with the clutch 37.

Next referring to FIG. 4*b*, A bridge is formed by the photoelectric cell 26, a resistor 71, a potentiometer 72 and a resistor 73, each of which is coupled to each of four arms of the bridge. The junction of the cell 26 and the potentiometer 72 is connected to the ground and the junction of the resistor 71 and 73 is connected to DC positive power source through a resistor. Across the junctions, Zener diode 74 is connected. The junction between the photoelectric cell 26 and the resistor 71 and the tap terminal of the potentiometer 72 are connected to the input terminals of an operational amplifier 75. The output terminal of the operational amplifier 75 is connected through a diode 76 and a resistor 77 to the base of a transistor 78. A bias voltage is applied to the base of the transistor 78 through the microswitch 16 and a resistor 79, and the emitter of the transistor 78 is grounded through a diode 80. The collector of the transistor 78 is connected to the DC power source through the relay 50.

A uni-junction transistor 81 which is operated in response to the signals supplied through contacts 68-1 and 69-1 of the supervisory relays 68 and 69 has an emitter connected to output terminals of two timers for detections of the delay in copying paper transportation and the jamming and has one base connected to the gate electrode of a thyristor 82. The anode of the thyristor 82 is connected to the base of a transistor 85 through a resistor 83 and a diode 84 whose emitter is grounded and whose collector is connected through a resistor 86 to the DC power source. The collector of the transistor 85 is also connected to the base of a transistor 88 through a diode 87. The emitter of the transistor 88 is grounded through a diode 89, and the collector is connected through the relay 54 to the DC power source. The junction between the base of the transistor 88 and the diode 87 is connected to the base of a transistor 90 through diodes 91 and 92. The emitter of the transistor 90 is grounded and the collector is connected through a diode 93 to the junction between the base of the transistor 78 and the diode 76. The anode of a thyristor 95 is connected to the junction between the diodes 91 and 92 through a contact 94-1 associated with a relay 94, and the cathode is grounded. The gate electrode is connected to a timer which is controlled by a contact 57-4 of the relay 57.

Referring to FIG. 4*c*, a circuit consisting of the main motor 14, a diode 96 and a capacitor 97 is connected to a power source through a transfer contact 59-1 of the relay 59. A series circuit consisting of a parallel circuit consisting of a motor 98 for driving a developing station and a relay 94 and a parallel connected microswitches 27 and 27' is connected to the power source.

Figure 5:
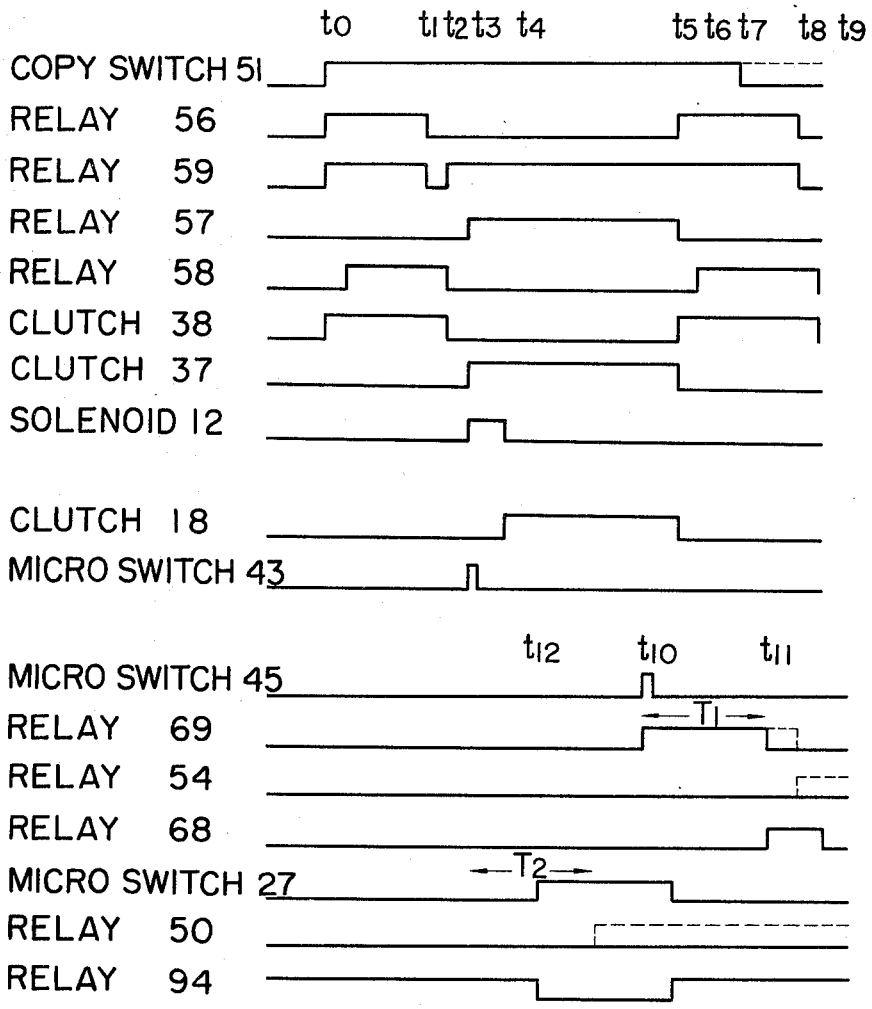
FIG. 5 is a timing chart used for the explanation of the mode of operation of the safety device.

Mode of Operation, FIG. 5

Next the mode of operation of the safety device with the construction described above will be explained with reference to the timing chart shown in FIG. 5.

The copy switch 51 is depressed at time $t_0$ so that the relay 56 is energized and the clutch 38 is engaged. Therefore the original holder 9 is retracted. At time $t_1$ the microswitch 42 is opened so that both relays 56 and thus 59 are de-energized. In this case the relay 58 is de-energized later than the relays 56 and 59 so that the clutch 38 is disengaged at $t_2$. During time duration between $t_1$ and $t_2$ the main motor 14 is directly drivingly coupled to the photosensitive drum 19 and the original holder 9, but the relay 59 remains de-energized. The charge stored in the capacitor 97 through the contact 59-1A is discharged through the contact 59-1B and the winding of the main motor 14 so that the retarding force is applied to the main motor 14.

At time $t_2$ the relay 58 is de-energized and the relay 59 is energized again so that the main motor 14 drives the photosensitive drum 19, and at time $t_3$ the microswitch 43 is closed and the relay 57 is energized so as to engage the clutch 37. Therefore the original holder 9 is advanced in synchronism with the photosensitive drum 19. In this instance the microswitch 47 is closed and the relay 62 is energized so that the contact 62-1 is closed. As a result the solenoid 12 is energized so that the rotation of the main motor 14 is transmitted to the copying paper pick-up roller 15 through the linkage 13. Therefore the copying paper is first curved or bowed, but is not advanced yet.

At $t_4$ the microswitch 46 is closed and the clutch 18 is engaged so that the feed rollers 17 are driven. Therefore the copying paper 11 is transported while actuating sequentially the microswitches 27 and 27'. The toner image is transferred upon the surface of the copying paper by the transfer roller 20 and then the copying paper is transported into the fixing station 22 by the belt conveyor 21. When the copy is discharged through the discharge outlet 24, it interrupts the light beam from the light emissive means 28 to the photoelectric cell 29 at $t_5$. At this instant the original holder 9 opens the microswitch 44 so that the relay 57 and the clutch 37 are de-energized whereas the relay 56 and the clutch 36 are energized. Therefore the original holder 9 starts to retract. At time $t_7$ the copy switch 51 is opened, and at time $t_9$ the original holder 9 is stopped. However in case of the continuous copying operation the copy switch 51 remains closed so that the retarding operation carried out during the time duration between $t_1$ and $t_2$ is cycled during the time duration $t_8$ and $t_9$, and then the similar operations are cycled from time $t_9$ which corresponds to the time $t_3$. When the copying paper on the holder 10 runs out, the light beam from the light emissive means 25 is intercepted by the photoelectric cell 26 so that the bridge consisting of the photoelectric cell 26 and the resistors 71, 72 and 73 is unbalanced. As a result the output of the operational amplifier 75 becomes positive so that the transistor 78 is conducted. The relay 50 is energized and the microswitch 16 is closed when the pick-up roller is not in the lowered position.

When the copying paper fails to reach the microswitch within the time $t_3$ at which the contact 57-4A is closed so that the charging of the capacitor 99 is started, the thyristor 95 is conducted whereas the transistor 90 is cut off. Therefore the transistor 78 is conducted so as to energize the relay 50. In this case the transistor 88 is cut off so that the relay 54 is de-energized.

However, when the copying paper is correctly transported so that the leading edge of the paper actuates the microswitch 27, the relay 94 is energized and the thyristor 95 remains cut off. The potential in the path 2 is positive but the potential in the path 1 is negative because the transistor 90 is conducted. As a result the diode 93 is reverse-biased. When the paper is advanced the microswitches 27 almost remain closed, so that there is no time for allowing the thyristor 95 to conduct after the copying paper has passed through the microswitch 27. As far as the normal transportation through the copying machine of the copying paper is detected in the manner described above, the diode 91 in the path 2 is reversed biased so that the operation of the relay 54 is not interrupted.

If the jamming should occur the copying paper fails to reach the outlet within a predetermined time $T_1$ after the microswitch 45 is closed at time $t_{10}$ even though the positive output in the path 2 indicates that the copying paper has been advanced into the passage. When the microswitch 45 is closed, the light from the light source 28 is intercepted by the photoelectric cell 29 so that the transistor 63 is cut off whereas the transistor 66 is conducted. Therefore the transistor 67 is conducted so that the relay 69 may remain energized. The capacitor 102 is charged through a circuit consisting of a variable resistor 101, a fixed resistor 100, and the contact 69-1A, and the thyristor 82 is conducted during the time $T_1$. Then the transistor 85 is cut off whereas the transistor 88 is conducted because the negative clamp of its base is released so that the relay 54 is energized. The contact 54-1 interrupts the power source from the main motor 14, the copying machine may be immediately stopped.

It is preferable that the relay 54 functions as a mechanical memory so that the operation may be continued unless the operator himself resets the copying machine after having checked the jamming condition.

The relay 68 which remains energized when the light beam from the light emissive means is intercepted by the photoelectric cell is de-energized when the copying paper is passing through the discharge outlet. Therefore a capacitor 105 is charged through a resistor 103, a variable resistor 104, and a contact 68-1B. When the time required for the copying paper to pass through the discharge outlet is in excess of a predetermined time the relay 54 is energized as in the case of the relay 69.

As described hereinbefore according to the present invention the exhaust of stocked copying paper, the failure in feeding copying paper, jamming and the like are detected by the detectors disposed in various positions in the copying machine so that the safety countermeasure may be immediately taken. Thus the present invention provides an improved safety device for use with a copying machine which may ensure the high efficiency photocopying operation.

I claim:

1. In a photocopying machine having a copy sheet stand for stocking copying paper to be sequentially fed into said machine, transporting means for picking up copying paper from said copy sheet stand and transporting said copying paper along a predetermined path through said machine, a driving system for driving said transporting means, heating means disposed along said predetermined path for processing said copying paper passing thereby, an electrical system for actuating at least said heating means, discharge means for discharging said copying paper from said machine after it has traveled along said predetermined path; a safety device comprising:

first detecting means for detecting when the stock of copying paper on said copy sheet stand is exhausted;

second detecting means for detecting a failure in feeding the copying paper from the copy sheet stand;

third detecting means for detecting a failure is discharging the copying paper from said discharge means;

means for interrupting said driving system in response to either said first detecting means detecting exhaustion of copy paper from the copy sheet stand or said second detecting means detecting a failure in feeding the copying paper from the copy sheet stand, in such a manner that the driving system can be restarted by actuating the power supply switch to off and then to on;

means for immediately interrupting said electrical system in response to said second detecting means not detecting a failure in feeding the copy paper from the copy stand and the third means detecting a failure in discharging the copying paper from said discharge means and said means for immediately interrupting said electrical system including means for retaining said electrical system in its interrupted mode regardless of the actuation of said power switch to off and then to on, until manually reset.

* * * * *

UNITED STATES PATENT OFFICE

CERTIFICATE OF CORRECTION

Patent No. 3,970,384 Dated July 20, 1976

Inventor(s) EISUKE YAMAMOTO, SUSUMU SUGIURA and OSAMU SAWAMURA

It is certified that error appears in the above-identified patent and that said Letters Patent are hereby corrected as shown below:

Claim 1, Column 8, line 12, delete "is" and insert --in--.

Signed and Sealed this

Twenty-first Day of September 1976

[SEAL]

*Attest:*

RUTH C. MASON
*Attesting Officer*

C. MARSHALL DANN
*Commissioner of Patents and Trademarks*